US007398799B2

(12) United States Patent
Gaubert et al.

(10) Patent No.: US 7,398,799 B2
(45) Date of Patent: Jul. 15, 2008

(54) DEVICE FOR HOOKING BETWEEN ELEMENTS OF A SHED FORMING DEVICE, METHOD FOR MANUFACTURING IT AND METHOD FOR HOOKING BY MEANS OF SUCH A DEVICE

(75) Inventors: Philippe Gaubert, Chassieu (FR); Michael Himmelstoss, Luzinay (FR); Patrice Przytarski, Saint Genis l'Argentiere (FR)

(73) Assignee: Staubli Lyon, Chassieu (FR)

( * ) Notice: Subject to any disclaimer, the term of this patent is extended or adjusted under 35 U.S.C. 154(b) by 111 days.

(21) Appl. No.: 11/477,949

(22) Filed: Jun. 30, 2006

(65) Prior Publication Data

US 2007/0017592 A1 Jan. 25, 2007

(30) Foreign Application Priority Data

Jul. 6, 2005 (FR) ..... 05 07199

(51) Int. Cl.
*D03C 3/00* (2006.01)
*D03C 3/16* (2006.01)
*D03C 3/40* (2006.01)
*D03C 3/24* (2006.01)

(52) U.S. Cl. ..... 139/59; 139/87; 139/85; 139/61; 139/63; 139/65

(58) Field of Classification Search ..... 139/59–65, 139/87, 88, 89, 85
See application file for complete search history.

(56) References Cited

U.S. PATENT DOCUMENTS 1,720,272 A * 7/1929 Harris ..... 403/210
2,557,033 A * 6/1951 Lake ..... 139/89
2,565,375 A * 8/1951 Lake ..... 403/263
2,700,398 A * 1/1955 Green ..... 139/88
3,736,962 A * 6/1973 Rademacher ..... 139/85
4,034,782 A 7/1977 Bucher
5,279,335 A * 1/1994 Bassi ..... 139/59
5,309,950 A * 5/1994 Bassi et al. ..... 139/88
5,333,652 A * 8/1994 Bassi et al. ..... 139/455
5,392,820 A * 2/1995 Seiler ..... 139/455
5,671,782 A * 9/1997 Lemaire et al. ..... 139/85
5,996,648 A * 12/1999 Himmelstoss ..... 139/455
6,014,989 A 1/2000 Tachon
6,230,755 B1 * 5/2001 Debaes et al. ..... 139/85
6,880,582 B2 * 4/2005 Vanderjeugt et al. ..... 139/88
2003/0221737 A1 * 12/2003 Vanderjeugt et al. ..... 139/88
2004/0216797 A1 * 11/2004 Porter ..... 139/85

FOREIGN PATENT DOCUMENTS

EP 0 915 195 5/1999

* cited by examiner

*Primary Examiner*—Gary L. Welch
*Assistant Examiner*—Bobby H Muromoto, Jr.
(74) *Attorney, Agent, or Firm*—Dowell & Dowell PC

(57) ABSTRACT

A device for hooking a heddle of a weaving loom of the Jacquard type to a harness cord of the loom that includes an endpiece molded on an upper end of the heddle. The endpiece including an aperture for the passage and wedging of the cord and a housing for receiving two strands of the cord. The device also includes a rigid sleeve reciprocally slidably mounted on the endpiece between a first position, in which it allows access to the aperture, and a second position, in which it covers the aperture and exerts a compressive force for constricting the aperture and blocking access to the lower end of the cord. The device may also be used for hooking one or more cords on a string.

17 Claims, 3 Drawing Sheets

DEVICE FOR HOOKING BETWEEN ELEMENTS OF A SHED FORMING DEVICE, METHOD FOR MANUFACTURING IT AND METHOD FOR HOOKING BY MEANS OF SUCH A DEVICE

BACKGROUND OF THE INVENTION FIELD OF THE INVENTION

The invention relates to a device for hooking a heddle on a harness cord of a weaving loom of the Jacquard type or a harness cord on a string of a Jacquard loom, and to a Jacquard loom equipped with such a device. The invention also relates to a method for the manufacture of such a device and to a method for hooking a heddle on a Jacquard harness cord by means of such a device.

BRIEF DESCRIPTION OF THE PRIOR ART

A Jacquard mechanism hook is conventionally associated with a string to which one or more cords are connected, the set of cords forming the harness of the Jacquard mechanism. In its lower part, each cord has to be hooked to the upper end of a heddle which comprises an eye for the passage of a warp thread. To carry out this hooking, it is known from EP-A-0 915 195 to injection-mould on the upper end of a heddle an endpiece which forms an orifice for the passage and wedging of the lower part of a cord, a flexible sheath of synthetic material being then slipped around the endpiece in order to assist in immobilizing the lower part of the cord. To exert a significant clamping force, such a sheath must have a relatively large thickness, thus giving rise to friction between the various sheaths mounted on adjacent heddles during the crossing of two heddles driven in opposite movements when the layout density of the heddles is high. These sheaths must also be relatively long in order to exert a sufficient clamping force. In practice, the length of these sheaths is at least greater than their strokes in order to prevent their ends from catching with one another. As a result of this, these sheaths, having considerable length and diameter, form a compact assembly in the upper part of the heddles, this assembly limiting access to the warp threads through the harness during maintenance operations. It also happens that these sheaths yield, thus giving rise to a risk of slipping of the cords in relation to the endpieces.

There are, moreover, heat-shrinkable sheaths which are placed onto the upper ends of the heddles after a cord has been knotted. Once heat-shrunk, these sheaths have a highly irregular external shape which is the image for the shape which they surround, this external shape having protuberances causing premature wear during repeated contacts at the crossing between the sheaths mounted on adjacent heddles.

It is also known from the FR-A-2 822 479 to use a tubular portion made of plastic or of metal in order to clamp the lower end of a cord in a longitudinal slot formed in an endpiece injection-moulded on the upper end of a heddle. The V-shape of the slot does not allow an efficient clamping of the cord which risks slipping when the loom is in operation, which makes the control of the heddle inaccurate and may cause faults in the shed. Furthermore, the slot, which extends over the entire length of the endpiece, embrittles this endpiece in the region of the injection-moulding zone of the heddle. An additional endpiece has to be mounted in the lower part of the tubular section, thus complicating the mounting operation. Finally, before the wedging of the cord, the tubular section is separated from the endpiece completely, so that it can slide level with the eye and with the bottom of the heddle.

The invention is intended more particularly to remedy these disadvantages by providing a novel hooking device, the overall diametral size of which may be greatly reduced, thus allowing a high layout density of the heddles, thereby making efficient hooking possible, and which is easy to mount.

SUMMARY OF THE INVENTION

The invention relates to a device for hooking a first element, of an assembly for the formation of the shed in a weaving loom of the Jacquard type, on a second element belonging to this assembly, the hooking device comprising an endpiece injection-moulded on the upper end of the first element and comprising two first branches, between which is defined an aperture for the passage of the lower end of the second element, this end comprising two strands which extend upwards from a portion of this second element received in this aperture. This device is characterized in that the endpiece comprises two second branches, between which is defined a housing for receiving the abovementioned strands, and in that it also comprises a metallic sleeve mounted on the endpiece and movable in translational motion on this endpiece between a first position, in which the sleeve allows access to the abovementioned aperture and does not interact with the second branches, and a second position, in which the sleeve exerts on the first branches and on the second branches a centripetal force for constricting the aperture and the housing and for wedging the abovementioned portion of the lower end of the second element and the adjacent strands respectively in the aperture and in the housing which are defined by the endpiece.

The use of a metallic sleeve makes it possible for the latter to remain cylindrical with a predetermined cross section, in practice circular, after it has been placed onto the endpiece equipped with a cord. Thus, the overall diametral size of the hooking device can be effectively controlled, thus limiting the risks of wear due to friction. In view of its rigid nature, the tube can exert a sufficient clamping force, whilst it can be substantially shorter and less thick than a conventional sheath. The result of this is that accessibility to the lower part of the harness and to the upper part of the set of heddles is greatly improved, as is accessibility to the warp threads for manual repairs to the harness. In view of the small length of the sleeve, the device can be light-weight. On account of the reduced diameter of the sleeve, the frictional forces are greatly reduced or even eliminated. Owing to the rigidity of the sleeve, the slip resistance of the cord is stable over time. The fact that the strands adjacent to the portion of the second element which is engaged in the aperture are received in the housing defined between the second branches makes it possible to obtain a blocking force distributed over the length of these strands, this being especially effective.

According to advantageous, but not mandatory, aspects of the invention, such a device may incorporate one or more of the following characteristics:

- The second branches are provided with free ends which are distant from one another when the sleeve is in its first position and which together form the upper end of the endpiece when the sleeve is in its second position.
- A first end of the sleeve which is located towards the front of the latter when it passes from its first position to its second position is widened forwards. In this case, the second end of the sleeve may be convergent, extending away from its first end.
- The sleeve and the endpiece are provided with complementary means which form an abutment stopping the translational movement of the sleeve from its first position towards its second position. By virtue of the stop means, a positioning of the tube is obtained, thus facilitating the mounting operation and the visual check of the good positioning of the heddles in terms of height. The aesthetic appearance of the harness is also improved. There may be provision for the sleeve and the endpiece likewise to be provided with complementary means forming an abutment stopping the translational movement of the sleeve from its second position towards its first position. The means forming an abutment advantageously comprise a relief which is formed on an outer peripheral surface of the endpiece and against which one end of the sleeve comes to bear when the sleeve arrives in one of its positions from the other position. The relief may comprise at least one tooth, against which one end of the sleeve comes to bear when the sleeve arrives in its first position from its second position, this tooth being compatible with a displacement of the sleeve towards its first position from a position opposite the second position.

The sleeve and the endpiece are provided with complementary means for immobilizing the sleeve on the endpiece in the second position by the cooperation of shapes. These immobilization means may likewise consist of abutment means stopping the translational movement of the sleeve from its first position towards its second position. These immobilization means advantageously comprise at least one reentrant relief formed in a running part of the sleeve and at least one complementary relief formed on a part of the endpiece which is elastically deformable when the sleeve passes from its first position to its second position. There may be provision for the complementary relief to be formed on one of the two first branches.

The sleeve is made from stainless steel or from a copper-based alloy, with a wall thickness smaller than 0.6 mm, preferably smaller than 0.3 mm, more preferably of the order of 0.1 mm.

The endpiece possesses, level with or in the vicinity of each of its ends, a substantially conical or frustoconical zone which is convergent, extending away from the opposite end. This makes it possible to limit the risks of catching between adjacent devices mounted on a loom.

The second branches are provided with means for centring one of the strands according to a longitudinal axis of the endpiece. The invention also relates to a weaving loom of the Jacquard type which comprises at least one hooking device, as described above. Such a loom is more economical, and the changes of its harness are easier and quicker than those of the prior art.

The invention also relates to a method for the manufacture of a device, as described above, which comprises steps involving:

a) installing the sleeve on the first element at a distance from its upper end, b) injection-moulding the endpiece on the first element, and c) if appropriate, displacing the sleeve towards its-first position on the endpiece.

Step c) is optional, in as much as it can be carried out later, particularly when the device is used for hooking a heddle on a harness cord.

Finally, the invention relates to a method for hooking a heddle of a weaving loom on a Jacquard harness cord by means of a device, as described above, this method comprising steps involving:

d) introducing the cord into the aperture of the endpiece, e) arranging the strands in the housing formed between the second branches, and f) displacing the sleeve from its first position towards its second position.

BRIEF DESCRIPTION OF THE DRAWINGS

The invention will be better understood and other advantages of the latter will become apparent more clearly in the light of the following description of three embodiments of the hooking device and of a Jacquard loom which are in accordance with its principle, this description being given solely by way of example and being made with reference to the accompanying drawings in which.

DESCRIPTION OF THE PREFERRED EMBODIMENTS

Figure 1:
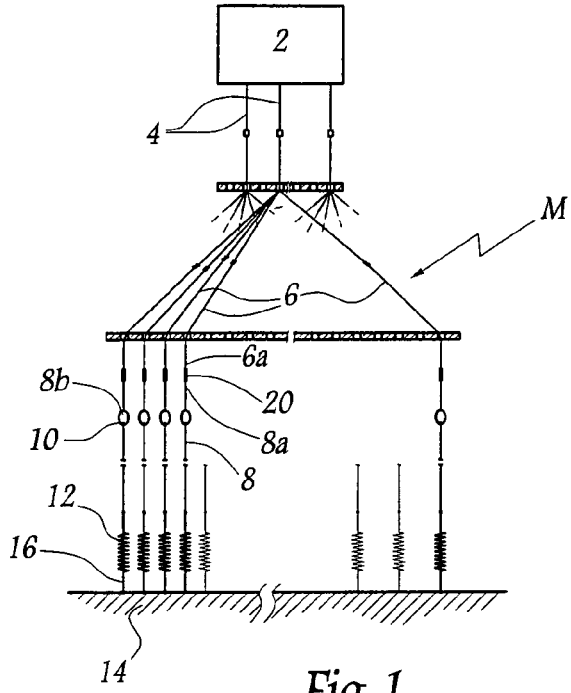
FIG. 1 is a partial diagrammatic illustration of a weaving loom according to the invention.

The loom M illustrated in FIG. 1 is equipped with a Jacquard mechanism 2 which controls a plurality of strings 4, only one of which is illustrated and the lower end of which is associated with a plurality of cords 6, the assembly of cords forming the harness H of the loom. The lower end 6*a* of each cord 6 is connected to the upper end 8*a* of a heddle 8, each heddle being provided with an eye 8*b* for the passage of a warp thread 10 and being subjected to the action of a return spring 12 fixed to the frame 14 of the loom by means of a rod 16.

The heddles 8 may also be controlled individually by the mechanism 2, in which case each cord 6 is displaced individually by means of this mechanism.

Within the meaning of the present description, the adjective "upper" relates to a part or an element of a device which is directed upwards in a normal configuration of use of the loom M, that is to say upwards in FIG. 1, whilst the adjective "lower" designates a part or an element directed downwards in this configuration.

A hooking device 20 is used for connecting the upper end 8*a* of each heddle 8 to the lower end 6*a* of the corresponding cord 6. This device 20 comprises an endpiece 22 injection-moulded on the end 8*a* in the form of a substantially cylindrical body 221 of circular cross section. Beyond the end 8*a*, the body 221 is prolonged by two branches 222 and 223, between which is defined an aperture 224, of which the dimensions in the plane of FIGS. 3 and 5 may vary as a function of a possible mutual approach of the branches 222 and 223 which are elastically deformable.

Figure 2:
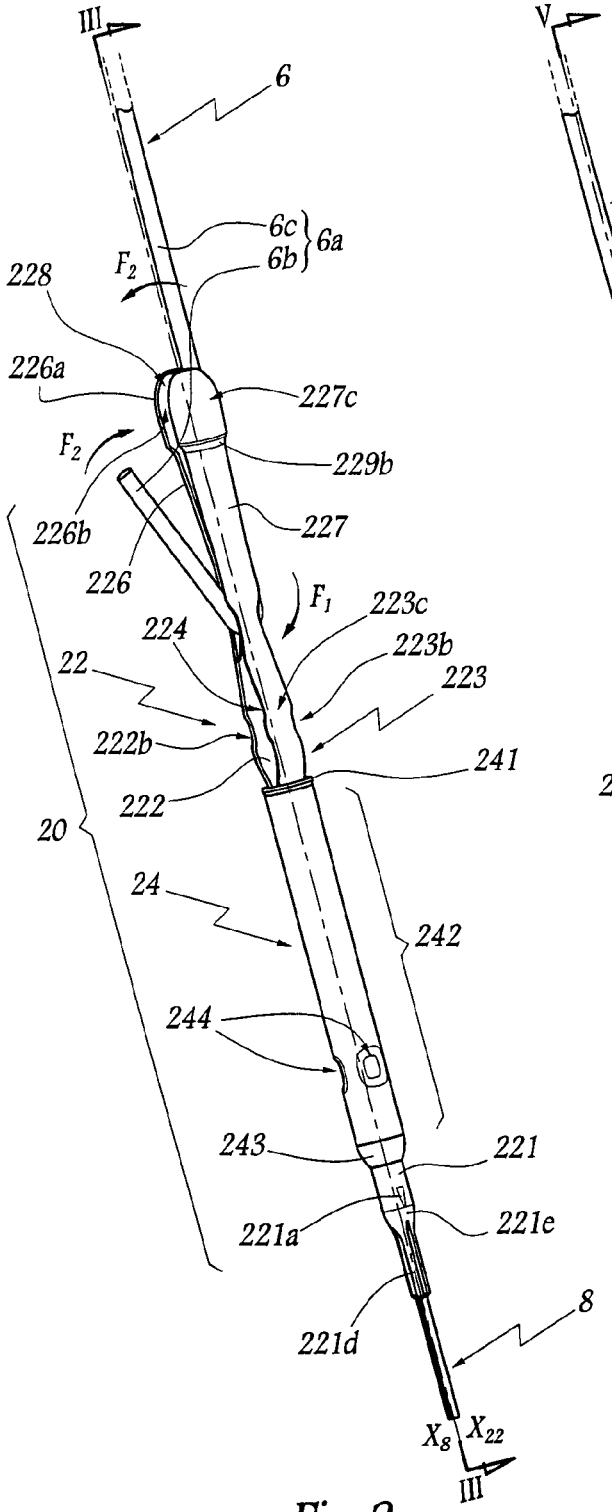
FIG. 2 is a perspective view, on a larger scale, of a device for hooking the upper end of a heddle on the lower end of a cord, the device being in a first configuration.
Figure 3:
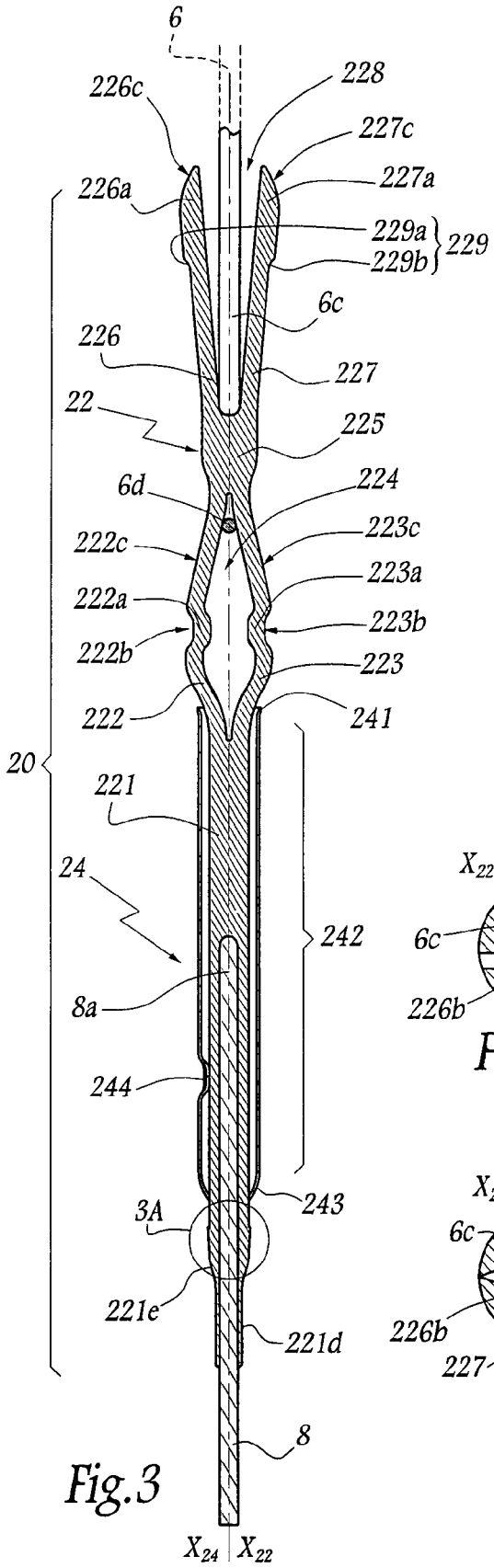
FIG. 3 is a longitudinal section along the line III-III in FIG. 2.

The branches 222 and 223 meet one another in a zone 225 which is opposite the body 221 and from which extend two other branches 226 and 227, the free ends 226*a* and 227*b* of which extend at a distance from one another when the endpiece 22 is not stressed, as illustrated in FIGS. 2 and 3.

The end 6*a* of the cord 6 can be engaged in the aperture 224. The two strands 6*b* and 6*c* formed by the cord 6 on either side of its part 6*d* received in the aperture 224 then extend along the zone 225 and are engaged in a through-gap 228 defined between the branches 226 and 227. The two strands 6*b* and 6*c* extend upwards from the portion 6*d* of the cord 6 which is received in the aperture 224.

As illustrated by the arrows $F_1$ and $F_2$ in FIG. 2, the end 6*a* can be engaged in the aperture 224 and then the strands 6*b* and 6*c* can be turned towards the gap 228 which thus forms a housing for receiving these strands.

The central longitudinal axis of the endpiece 22 is designated by $X_{22}$, this axis coinciding with the longitudinal axis $X_8$ of the heddle 8.

Each branch 222 and 223 is provided with a part 222*a*, 223*a* reentrant in the direction of the axis $X_{22}$ with respect to the rest of the branches 222, 223. These parts 222*a* and 223*a* thus define two zones 222*b* and 223*b* recessed with respect to the outer surfaces 222*c* and 223*c* of the branches 222 and 223 over most of their length.

A metallic sleeve 24 is mounted on the endpiece 22 and is intended for locking the end 6*a* of the cord 6 with respect to this endpiece when the adjustment of the height of the heddle 8 has been carried out by setting the position of this end 6*a* with respect to the endpiece 22. In a most advantageous way, the sleeve 24 is made from stainless steel or from a copper-based alloy, such as brass, so that it does not risk rusting, even if the loom M is liable to operate in a damp or aggressive environment. The sleeve 24 has a circular cross section over most of its length, and its wall is thin, its thickness being smaller than 0.3 mm, preferably in the neighborhood of 0.1 mm. In practice, the wall thickness of the sleeve 24 may be selected lower than 0.6 mm.

The end 241 of the sleeve 24 is widened, that is to say is divergent, extending away from its running part 242. The opposite end 243 is convergent in the direction of the central axis $X_{24}$ of the sleeve 24 and extending away from the part 242.

The length of the sleeve 24 is designated by $L_{24}$. This length is substantially smaller than that of the flexible sheaths used, for example, with the device known from EP-A-0 915 195. In practice, the length $L_{24}$ is between 10 and 40 mm, preferably of the order of 20 mm.

The sleeve 24 is provided with three localized dishings 244 uniformly distributed about the axis $X_{24}$ and reentrant in the direction of this axis. These three dishings or neckings define the minimized inside diameter of the sleeve 24, that is to say the nominal outside diameter of a component capable of being received in this sleeve in the region of these dishings.

The body 221 is provided with two teeth 221*a*, each defined between a surface 221*b* perpendicular to the axis $X_{22}$ and a surface 221*c* inclined in the direction of this axis, extending away from the aperture 224.

When the device 20 is to be manufactured, the sleeve 24 is shaped by means of conventional cutting and dishing techniques. It is then slipped onto the end 8*a* of the heddle 8 and displaced at a distance from this end in the direction of the eye 8*b*. The endpiece 22 is then injection-moulded on the end 8*a*. The sleeve 24 can subsequently be returned towards its first position illustrated in FIGS. 2 and 3, this being possible in spite of the presence of the teeth 221*a* because of the inclined nature of the surfaces 221*c* which allow the end 243 to pass over the teeth 221*a*. Once this passing has taken place, the tooth 221 forms an abutment with respect to a movement of the sleeve 24 in the direction of the eye 8*b*. The configuration of FIGS. 2 and 3 is thus assumed.

Alternatively, the sleeve 24 may be kept at a distance from the endpiece 22 or engaged on this endpiece, but without its end 243 going beyond the teeth 221*a*.

Once the end 6*a* of the cord 6 is put in place and the adjustment of the height of the heddle has been carried out, the cord is cut to length in order to provide the strand 6*b*, whilst the strand 6*c* prolonged upwards in order to form the intermediate part of the cord 6. The sleeve 24 is then displaced in the direction of the arrows $F_3$, that is to say in a reciprocating movement parallel to the axes $X_{22}$ and $X_{24}$, which then coincide, and in a direction moving away with respect to the eye 8*b* of the heddle 8. This makes it possible to reach the second position, illustrated in FIGS. 4 and 5, in which the end 241 of the sleeve 24 comes to bear against a shoulder 229 formed in two parts 229*a* and 229*b* on the outer surfaces of the branches 226 and 227. Thus, the end 241 and the shoulder 229 form an abutment with respect to the displacement of the sleeve 24 from its position of FIG. 2 to that of FIG. 4. On account of this displacement, the branches 222 and 223, on the one hand, and the branches 226 and 227, on the other hand, approach one another, at the same time constricting the aperture 224 and the gap 228. To be precise, the rigid nature of the sleeve 24 allows it to exert on the branches 222, 223, 226 and 227 a centripetal or compressive force $E_1$ in the direction of the axes $X_{22}$ and $X_{24}$, this force being sufficient to block the strands 6*b* and 6*c* in the gap 228 as a result of the mutual approach of the ends 226*a* and 227*a*, and to wedge the part 6*d* of the end 6*a* in the aperture 224.

In this region, an amplification effect is obtained with regard to the clamping force $E_1$ which is exerted by the sleeve 24 in the region of the parts 222*a* and 223*a* in order to "close" the branches 222 and 223 which tend to pivot about their fastening points on the zone 225. The end 6*a* of the cord is thus firmly gripped in the then flattened aperture 224. Where the strands 6*b* and 6*c* are concerned, these are likewise firmly pressed against the zone 225 and gripped between the branches 226 and 227 on account of the force $E_1$.

Figure 5A:
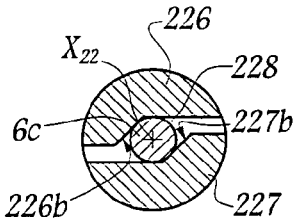
FIG. 5A is a cross section, on a larger scale, along the line A-A in FIG. 5.

As may be gathered more particularly from FIG. 5A, the mutually confronting surfaces 226*b* and 227*b* of the branches 226 and 227 are concave, with a shape allowing them to center the strand 6*c* on the axis $X_{22}$ when the force $E_1$ causes them to approach one another. In the example illustrated in FIG. 5A, the surfaces 226*b* and 227*b* each comprise two parallel portions connected by means of an inclined portion.

Figure 5B:
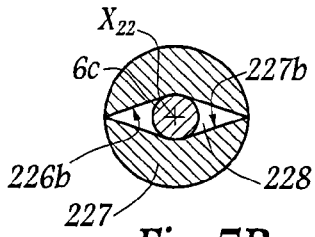
FIG. 5B is a cross section, similar to FIG. 5A, for a hooking device according to a second embodiment of the invention.

As illustrated in FIG. 5B for a variant of the invention, the surfaces 226*b* and 227*b* may be substantially in the form of an open V, thus likewise making it possible to center the strand 6*c* on the axis $X_{22}$.

Figure 6:
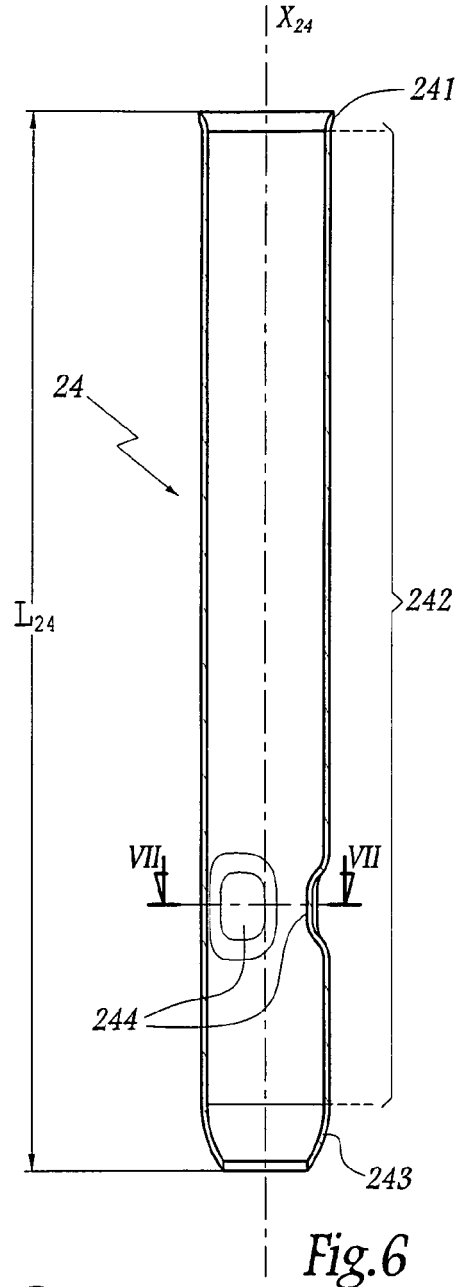
FIG. 6 is a longitudinal section, on a larger scale, of a sleeve used in the device of FIGS. 1 to 5.
Figure 3A:
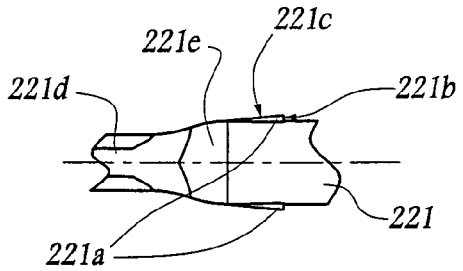
FIG. 3A is a side view, on a larger scale, of the detail 3A in FIG. 3.
Figure 7:
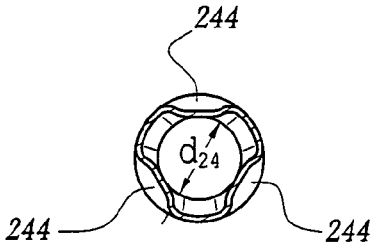
FIG. 7 is a section along the line VII-VII in FIG. 6.

The cross sections corresponding to FIGS. 5A and 6B are taken in a part of the endpiece 22 where only the strand 6*c* is present, the strand 6*b* being received in the housing 228 over only part of the height of this housing.

Figure 4:
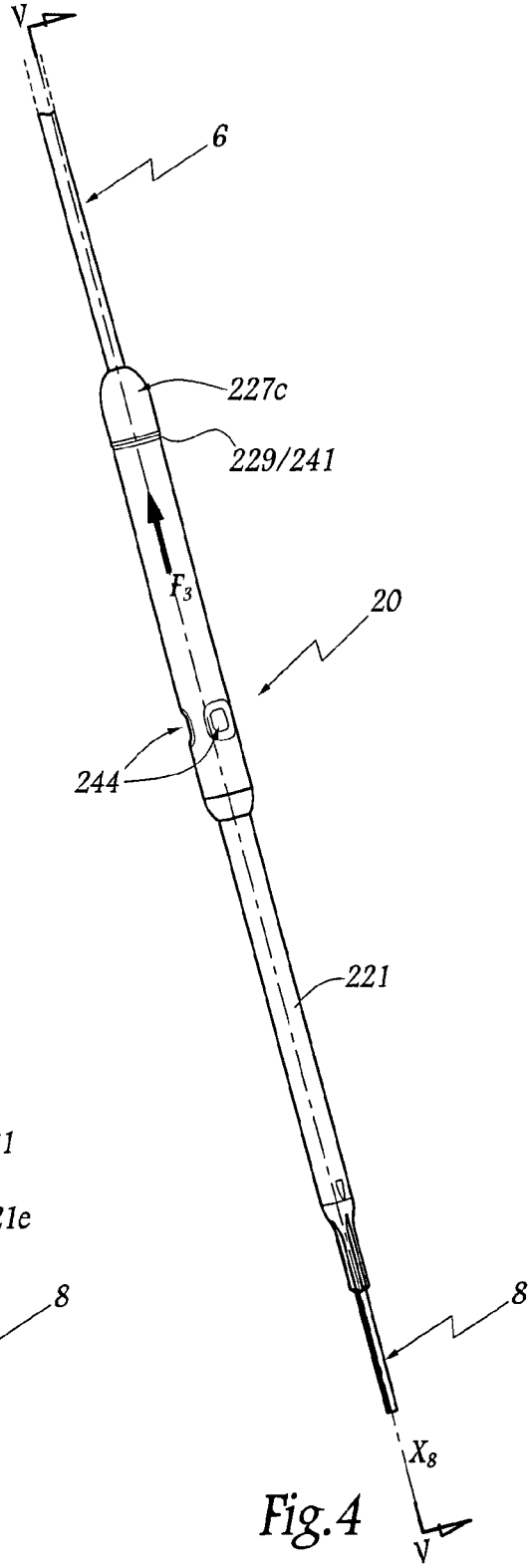
FIG. 4 is a view, similar to FIG. 2, when the hooking device is in a second configuration.
Figure 5:
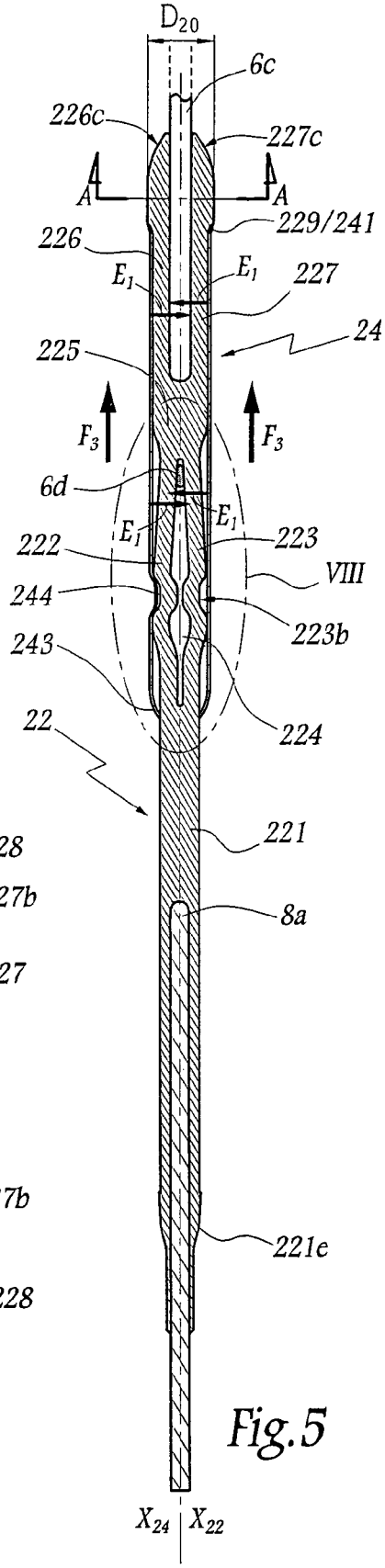
FIG. 5 is a longitudinal section along the line V-V in FIG. 4.

The displacement of the tube 24 from its first position towards its second position makes it possible to bring one of the dishings 244 level with one of the zones 222*b* and 223*b* of the branches 222 and 223, thus causing immobilization in the configuration of FIGS. 4 and 5 by the snapping of the sleeve 24 on the endpiece 22. The clamping force of the sleeve 24 is thus secure.

The zones 222*b* and 223*b* and the dishings 244 may likewise serve as an abutment with respect to the displacement of the sleeve 24 from its first position towards its second position. In this case, the sleeve is shorter than that illustrated in the figures, in such a way that its front end 241 does not interfere with the shoulder 229, the stopping of the displacement $F_3$ of the sleeve from its first position towards its second position being obtained when the dishings 244 engage in the zones 222*b* and 223*b*.

In any event, the fact that the front end 241 of the sleeve 24 is widened prevents this front end from marking or damaging the plastic forming the endpiece 22 during the displacement of the sleeve from its first position towards its second position. The widened nature of the end 241 is illustrated in the figure as the result of an outward deformation of the end 241. Alternatively, this widened nature could be obtained by means of an inner chamfer of the end 241, the outer surface of which would not be deformed.

The immobilization obtained in the configuration of FIGS. 4 and 5 is reversible in that it is possible to displace the sleeve 24 again towards the position of FIGS. 2 and 3 by expelling the dishings 244 from the zones 222*b* and 223*b* by means of an elastic deformation of the branches 222 and 223 which is of the same type as that which occurs at the termination of the stroke of displacement of the sleeve 24 from its first position towards its second position.

The use of the sleeve 24 makes it possible to control and limit the overall diametral size of the device 20, the maximum outside diameter $D_{20}$ of the device 20 then being determined by the thickness of the branches 226 and 227, without the sleeve 24 increasing this diameter.

The heddles can thus be laid out in a high density, whilst the risks of premature wear of the hooking devices are reduced or even eliminated.

The body 221 forms, in its part opposite the branches 226 and 227, a tube of small diameter 221*d* connected to the main part of the body 221 by means of a frustoconical zone 221*e* convergent in the direction of the eye 8*b*. In the configuration of FIGS. 4 and 5, the outer end surfaces 226*c* and 227*c* of the branches 226 and 227 are rounded and convergent towards the axis $X_{22}$, opposite the zone 225, with a substantially frustoconical shape. The upper end of the device 20, this upper end being defined by these surfaces, is thus shaped so as to limit shocks or friction with adjacent devices when this device is displaced upwards with respect to the adjacent devices. The zone 221*e* has the same function when the device 20 is displaced downwards.

In view of its small thickness and of its relatively modest length $L_{24}$, the sleeve 24 is lightweight and does not appreciably increase the inertia of the assembly formed by a cord 6 and by a heddle 8. On account of the very good definition of the location of the tube 24 in the position of FIGS. 4 and 5 by virtue of the abutment means 229 and 241 and/or 222*b* and 223*b*, it is easy to check that it is put in place correctly, especially when numerous heddles are juxtaposed in a predetermined configuration, in as much as the corresponding sleeves then have to be substantially aligned.

The mode of displacement of the sleeve 24 from its first position towards its second position and even in the opposite direction makes it possible to consider an automation of the corresponding movement, thus achieving an appreciable timesaving and laborsaving.

On account of the reversible nature of the putting in place of the sleeve 24 in the position of FIGS. 4 and 5, an adjustment in the length of the cord may be considered, the sleeve 24 being temporarily displaced towards its configuration of FIGS. 2 and 3 and then being returned to its place in its configuration of FIGS. 4 and 5, without any impairment in the clamping force obtained by means of the sleeve 24.

Figure 8:
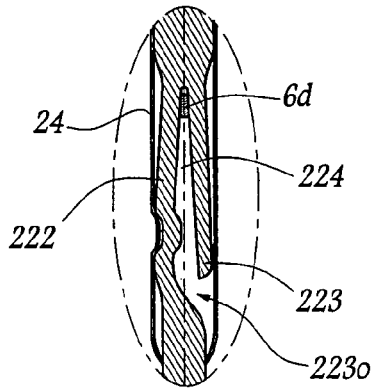
FIG. 8 is a view, corresponding to the detail VIII in FIG. 5, of a hooking device according to a third embodiment.

FIG. 8 relates to a second embodiment in which the elements similar to those of the first embodiment bear the same references. The aperture 224 of this embodiment is not surrounded completely by material, the branch 223 being interrupted and forming an aperture 223o for the lateral introduction of the portion 6*d* of the cord 6 in the aperture 224. Once the sleeve 24 is in place, this portion 6*d* is gripped in the aperture 224 by the branches 222 and 223.

In the device of the invention, the part of the body 221 which is injection-moulded on the end 8*a* of the heddle is separate from the part which is formed from the elements 222 to 229 and by means of which the end 6*a* of the cord is blocked. Thus, the hooking structure of the cord does not risk weakening the connection between the endpiece 22 and the heddle 8.

The sleeve 24 has been illustrated with a continuous circular cross section. It could be split longitudinally or be formed by the winding of a metal sheet with partial overlap.

The device may likewise serve for the connection between one or more harness cords 6 and a string 4. In this case, the upper end or upper ends of the cord or cords 6 is or are injection-moulded in the body 221 and the lower end of the string 4 is wedged in the aperture 224.

The invention claimed is:

1. A device for connecting a first element, of an assembly for the formation of a shed in a weaving loom of a Jacquard type, on a second element of the assembly for the formation of the shed, the device comprising an endpiece molded on an upper end of the first element and including two first branches that are compressible relative to one another and between which is defined an aperture for receiving a lower end of the second element therethrough so that the lower end will have two strands that may be extended upward from a portion of the second element received in the aperture, said endpiece including two second branches between which is defined a space for receiving the two strands, said two second branches having ends that extend away from said two first braches and that are compressible relative to one another, a metallic sleeve reciprocally mounted about said endpiece between a first position in which said sleeve is spaced from said two first and second branches and thereby allows access to the aperture and does not interact with said two second branches, and a second position in which said sleeve exerts on said first branches and on said second branches a compressive force for constricting the aperture and the space and for wedging the portion and the two strands respectively in the aperture and in the space.

2. The device according to claim 1, wherein said second branches form an upper end of said endpiece when said sleeve is in its second position.

3. The device according to claim 1, wherein a first upper end of said sleeve, which is oriented toward and spaced from said first and second branches when in its first position tapers outwardly.

4. The device according to claim 3, wherein a second end of said sleeve is convergent, extending away from the first end.

5. The device according to claim 1, wherein said sleeve and said endpiece are provided with first complementary means forming an upper abutment stopping the movement of said sleeve as said sleeve moves from its first position into its second position.

6. The device according to claim 5, wherein said sleeve and said endpiece are provided with second complementary means forming a lower abutment stopping the movement of said sleeve as said sleeve moves from its second position into its first position.

7. The device according to claim 5, wherein said first complementary means includes a relief which is formed on an outer peripheral surface of said endpiece adjacent an upper end thereof and against which said first upper end of said sleeve abuts when the said sleeve arrives in said second position.

8. The device according to claim 6, wherein said second complementary means is formed on an outer peripheral surface of said endpiece adjacent a lower end thereof and includes at least one tooth, against which the lower end of said sleeve abuts when said sleeve arrives in the said first position from said second position, said at least one tooth a displacement of said sleeve towards the said first position from a position opposite the second position.

9. The device according to claim 1, wherein said sleeve and said endpiece are provided with complementary means for immobilizing said sleeve on said endpiece in said second position by a cooperation of shapes.

10. The device according to claim 9, wherein said complementary means for immobilization includes means extending inwardly of said sleeve that seat within recessed zones in said first two branches for thereby resisting movement of said sleeve from its second position towards its first position.

11. The device according to claim 9, wherein said complementary means for immobilization means includes at least one reentrant relief formed in a portion of said sleeve and at least one complementary relief formed on a part of said endpiece, said part being elastically deformable when said sleeve passes from its first position to its second position.

12. The device according to claim 11, wherein said complementary means is formed on at least one of said two first branches.

13. The device according to claim 1, wherein said sleeve is made from a metal selected from a group of metals consisting of stainless steel and copper-based alloys, with a wall thickness smaller than 0.6 mm.

14. The device according to claim 1, wherein, when said sleeve is in its second position, said endpiece has at each of its ends, a substantially conical zone which is convergent, extending away from an opposite end thereof.

15. The device according to claim 1, wherein said second branches are provided with means for aligning one of said two strands along a longitudinal axis of said endpiece.

16. A weaving loom of the Jacquard type comprising at least one device for connecting a first element, of an assembly for the formation of a shed, on a second element of the assembly for the formation of the shed, the device including an endpiece molded on an upper end of the first element and including two first branches that are compressible relative to one another, between which is defined an aperture for receiving a lower end of the second element therethrough so that two strands of the lower end may be extended upward from a portion of the second element received in the aperture, said endpiece including two second branches that are compressible relative to one another and between which is defined a space for receiving the two strands, said two second branches having ends that extend away from said two first braches, a metallic sleeve reciprocally mounted about said endpiece between a first position in which said sleeve is spaced from said two first and second branches and thereby allows access to the aperture and does not interact with said two second branches, and a second position in which said sleeve exerts on said first branches and on said second branches a compressive force for constricting the aperture and the space and for wedging the portion and the two strands respectively in the aperture and in the space.

17. A method of manufacturing a connector for securing a heddle to a harness cord comprising:

A. Forming a metal sleeve having a first length and a first cross sectional dimension and thereafter placing the sleeve over a heddle so as to be spaced from an upper end portion of the heddle;

B. Molding an endpiece to the upper end portion of the heddle so that the endpiece includes a body portion of a second cross sectional dimension that is less than the first cross sectional dimension and that encloses the upper end of the heddle and from which extend, beyond the heddle, two first branches that are compressible relative to one another and that are normally spaced apart a distance greater than the first cross sectional dimension and that define an aperture therebetween in which a portion of a harness cord may be inserted and such that two second branches having ends that extend away from the two first branches so that portions of the harness cord above the aperture are receivable in a space between the two second branches and with the two second branches being normally spaced apart a distance greater than the first cross sectional dimension and being compressible relative to one another and wherein at least one tooth is molded to extend outwardly from the body and wherein a length of the body is greater than the first length of the metal sleeve; and C. Sliding the metal sleeve from the first portion of the heddle over the body so as to pass over the at least one tooth until the sleeve is positioned about the body of the endpiece in a first position between the at least one tooth and the two first branches and such that the at least one tooth prevents the metal sleeve from moving from the first position about the body of the endpiece back to the first portion of the heddle.

* * * * *